US009283564B2

(12) United States Patent
Sutti et al.

(10) Patent No.: US 9,283,564 B2
(45) Date of Patent: Mar. 15, 2016

(54) FRAME OF JAW CRUSHER, JAW CRUSHER AND CRUSHING PLANT

(75) Inventors: Risto Sutti, Tampere (FI); Kari Rikkonen, Tampere (FI); Ilkka Somero, Kanagasala (FI); Juhamatti Heikkila, Tampere (FI); Jari Jonkka, Tampere (FI); Mika Yli-Marttila, Hameenlinna (FI)

(73) Assignee: Metso Minerals, Inc., Helsinki (FI)

( * ) Notice: Subject to any disclaimer, the term of this patent is extended or adjusted under 35 U.S.C. 154(b) by 0 days.

(21) Appl. No.: 13/393,266

(22) PCT Filed: Sep. 28, 2009

(86) PCT No.: PCT/FI2009/050772

§ 371 (c)(1),
(2), (4) Date: Feb. 29, 2012

(87) PCT Pub. No.: WO2011/036334

PCT Pub. Date: Mar. 31, 2011

(65) Prior Publication Data

US 2012/0175447 A1 Jul. 12, 2012

(51) Int. Cl.

| | |
|---|---|
| ***B02C 1/02*** | (2006.01) |
| ***B02C 1/04*** | (2006.01) |
| *B02C 18/16* | (2006.01) |
| *B02C 13/282* | (2006.01) |

(Continued)

(52) U.S. Cl.

CPC ... *B02C 1/04* (2013.01); *B02C 1/02* (2013.01); *B02C 13/282* (2013.01); *B02C 19/00* (2013.01); *B02C 23/00* (2013.01); *B02C 2018/162* (2013.01)

(58) Field of Classification Search

CPC ..... B02C 1/10; B02C 13/2804; B02C 1/04; B02C 13/282; B02C 1/005; B02C 1/06; B02C 1/02; B02C 2018/162; E02F 3/965

USPC ..... 241/264–269, 285.1, 285.2, 285.3, 291, 241/300

See application file for complete search history.

(56) References Cited

U.S. PATENT DOCUMENTS

| | | | |
|---|---|---|---|
| 885,717 | A | 4/1908 | Brown |
| 2,125,666 | A | 8/1938 | Buchanan |
| 3,425,639 | A | 2/1969 | Kueneman |

(Continued)

FOREIGN PATENT DOCUMENTS

| | | | |
|---|---|---|---|
| EP | 1 049 539 | B1 | 5/2007 |
| JP | 2007-185566 | A | 7/2007 |

OTHER PUBLICATIONS

Translation of JP2007185566A, Inventor Arakawa Kazuaki, Title Jaw Crusher.*

(Continued)

*Primary Examiner* — Faye Francis
*Assistant Examiner* — Onekki Jolly
(74) *Attorney, Agent, or Firm* — Andrus Intellectual Property Law, LLP

(57) ABSTRACT

A frame of a jaw crusher comprises a front wall for receiving crushing force and side walls connected to the front wall. The frame of the jaw crusher comprises a front part and a rear part joinable to the front part, and the front part comprises the front wall, and a major part of the front wall and the front part of both side walls form a unitary piece. A jaw crusher and a crushing plant.

17 Claims, 3 Drawing Sheets

(51) Int. Cl.
*B02C 23/00* (2006.01)
*B02C 19/00* (2006.01)

(56) References Cited

U.S. PATENT DOCUMENTS 3,621,901 A * 11/1971 Dodgen et al. ..... 241/101.762
4,244,532 A * 1/1981 Kroening et al. ..... 241/264
5,482,218 A * 1/1996 Ha ..... 241/30
5,524,839 A * 6/1996 Schade et al. ..... 241/101.2
6,155,507 A * 12/2000 Ostergaard ..... 241/264
6,581,862 B1 * 6/2003 Young et al. ..... 241/189.1
2002/0038833 A1 * 4/2002 Lehtonen et al. ..... 241/264
2003/0042345 A1 * 3/2003 Ostergaard ..... 241/264
2005/0173574 A1 * 8/2005 Lehtonen et al. ..... 241/264
2006/0097095 A1 * 5/2006 Boast ..... 241/264
2009/0095833 A1 * 4/2009 Nakayama et al. ..... 241/264

OTHER PUBLICATIONS

PCT International Search Report and Written Opinion dated Jun. 2, 2010.
Supplementary Partial European Search Report dated Dec. 1, 2015.

* cited by examiner

FRAME OF JAW CRUSHER, JAW CRUSHER AND CRUSHING PLANT

CROSS-REFERENCE TO RELATED APPLICATIONS

This application claims priority to PCT/FI2009/050772, filed Sep. 28, 2009, and published in the English language on Mar. 31, 2011 as Publication No. WO 2011/036334, incorporated herein by reference.

FIELD OF THE INVENTION

The invention relates to a frame of a jaw crusher, a jaw crusher and a crushing plant which are suitable for crushing mineral material.

BACKGROUND OF THE INVENTION

Frames of jaw crushers have been manufactured in many different ways. One typical frame of a jaw crusher comprises side plates and ends which are assembled with bolt joints. A jaw crusher may also comprise a completely casted or a completely welded frame.

Side plates of a jaw crusher are attached with bolt joints to, for example, casted ends in which shear forces created while loading the crusher are received with extending pins casted to the ends. The movement between friction surfaces of the bolt joints exposes joints to loosening and/or fretting fatigue that decreases considerably fatigue strength of the side plates and the ends. Due to the loosening frame bolts of the side plates attached to the ends require regular checking and when needed after-tightening.

Initiation of a crack from contact surfaces of two pieces pressed together is called fretting fatigue. For initiation of a crack typically a continuous low amplitude vibration gliding occurs between attaching surfaces of the side plates and the ends. Fretting fatigue is a very serious form of fatigue because it may also occur in such areas which are not critical regarding to stress. Controlling the fretting phenomenon is computationally difficult and laborious because influences of friction, such as friction coefficient, in joints are not accurately known.

Extending pins receiving shear forces of present multipart frame assembled with bolts and casted to the ends of the frame cannot be replaced when the pins wear away. In bolt joints, especially due to the large amount of frame bolts, lots of places critical to the fretting fatigue are caused to the frame because users easily forget after-tightening of frame bolts. Lots of frame bolts and massive base plates used with the frame bolts and lots of extending pins are used in the multipart frame of a jaw crusher due to which expensive machined surface must be plentifully produced to the frame. Thus, the amount of parts and expensive machining grows high that increases price and assembly time.

Very many critical fatigue vulnerable places are formed to a welded frame of a jaw crusher due to the high amount of welding seams, especially, if there are welding joints getting under stress in the area of the front wall subject to crushing load. Welding decreases fatigue strength of the base substance. Quality assurance of the weldings in the welded frame increases costs. Quality assurance in complex welded structures is difficult and expensive.

A thick intermediate piece behind a wear part of a fixed jaw is used to adjust the jaw angle of a jaw crusher in some applications, which intermediate piece may be replaced. The intermediate piece is heavy and difficult to mount. Relievings for decreasing weight have been made to the known adjustment plates of the jaw angle that increases manufacturing costs.

Patent publication EP1049539B1 describes a jaw crusher which has a frame assembled of many parts.

SUMMARY

According to a first aspect of the invention there is provided a frame of a jaw crusher which comprises a front wall for receiving crushing force and side walls connected to the front wall. The frame of the jaw crusher comprises a front part and a rear part joinable to the front part, and the front part comprises the front wall, and a major part of the front wall and front parts of both side walls form a unitary piece.

Preferably the rear part of the frame comprises a unitary piece which is formed of rear parts of both side walls of the frame and at least one structure part connecting these rear parts of the side walls.

Preferably at least one of the front part and the rear part is manufactured by casting to a unitary piece.

Preferably the front part and the rear part are joinable to each other with joints which connect front parts and rear parts of the side walls on both sides of the frame.

According to some embodiments the front part and the rear part of the frame are joinable to each other with flange-screw joints. Preferably the flange-screw joint is disassemblable.

Preferably the flange-screw joint comprises in the side wall of the front part at least one first flange and in the rear side wall of the rear part at least one second flange, and first and second flanges are tightenable towards each other with attaching means having influence on flanges such as screws.

Preferably the flange-screw joint comprises an intermediate plate with a selectable equal thickness which is mountable between the first and second flanges.

Preferably the flange-screw joint comprises a wedge-like intermediate plate with a selectable constant thickness or an adjustment wedge which may be mounted peak pointed up or down, mountable between the first and second flanges.

According to some embodiments the frame comprises a welding joint on its both sides between a side wall of a front part and a rear side wall of a rear part. The welding joint may comprise one welding seam. Amount of welding joints and welding work in manufacture of the frame may be considered as small.

According to some embodiments the front part and the rear part of the frame are joinable to each other with a fork-pin joint. Preferably the fork-pin joint is disassemblable.

Preferably the fork-pin joint comprises a fork in the side wall of the front part and/or the rear part, and a tongue as a counter joining part, correspondingly, in the side wall of the rear part and/or the front part, which tongue is adaptable between walls of the fork, and the fork and the tongue comprise holes for an attaching means, for example, pin holes for the pin.

The frame may comprise an upper and a lower fork-pin joint on both sides of the frame.

The forks and the tongues may be plate structures in the direction of the walls of the front part and the rear part.

At least one fork-pin joint may comprise the fork and the tongue formed of plate structures deviating from the direction of the walls of the front part and the rear part.

Preferably the frame comprises as an attaching means for mounting the front part and the rear part to each other any of the following: screw, pin, hydraulic nut, hydraulic cylinder, electric cylinder.

According to a second aspect of the invention there is provided a jaw crusher for crushing mineral material, which jaw crusher comprises a frame of a jaw crusher according to any embodiment of the invention.

According to a third aspect of the invention there is provided a crushing plant which comprises a frame of a jaw crusher according to any embodiment of the invention or a jaw crusher according to any embodiment of the invention.

Preferably the crushing plant comprises a frame of a crushing plant which frame is configured to receive the mass of the frame of the jaw crusher.

The frame of a crusher assembled of two frame parts which frame's front part is manufactured by casting has many advantages. Joints proven to be problematic between load transferring large frame pieces are less needed, and the weight of frame parts handled in the manufacture of pieces is held moderate. Because the casting of the frame may be realized in two parts the casting may be made simpler than of one big part. For smaller parts there are several alternative places for making the actual casting work.

The amount of frame parts of the crusher may be considerably decreased when compared to a frame which comprises side plates and ends which are assembled to each other with bolt joints. The amount of machined surface may be considered as small in the preferred embodiments of the present invention. The weight of the frame may be decreased even with a fifth when compared to frames equipped with extending pins and joined with bolt joints.

In some embodiments of the frame of the jaw crusher the after-tightening problem of bolts may be considerably avoided. In some embodiments of the frame of the jaw crusher fretting fatigue problems are eliminated.

A fork-pin joint may be gotten gapless. Because the joint may be placed in the middle area of the side walls of the frame half of the amount of pins of some solutions is needed in which solutions side plates and ends are assembled to each other with bolt joints. In some embodiments of the present invention the pin may be considered as a beam with two supports and not as a cantilever beam according to known steel cast pins wherein the pin may be dimensioned by its diameter considerably smaller than known pins. In that case the hole for fork-pin joint formed in the casting material of the frame may be formed small so that the stress concentration in the area of the pin hole may be gotten low. In question is a situation defined to be dimensionally static wherein the pins, the fork eye and the tongue may be analytically dimensioned to correspond the load of the crushing event. The amount of fatigue critical places of joints of the frame may be decreased and the influence of friction may be considered to be small. Pin joints are easy to mount. Pins may be replaced easily.

Fatigue resistance of joining parts such as bolts and pins may be improved when compared to many known solutions because material with a better fatigue resistance than of steel casting material may be chosen as material for joining parts. The pin may be made, for example, of screw material. Other advantages come up in the following description and in claims.

Different embodiments of the present invention will be illustrated or have been illustrated only in combination with one or some aspects of the invention. A person skilled in the art understands, that any embodiment of one aspect of the invention may be applied in the same aspect of the invention and in other aspects alone or as a combination with other embodiments.

BRIEF DESCRIPTION OF THE DRAWINGS

The invention will be described, by way of example, with reference to the accompanying schematical drawings, in which.

DETAILED DESCRIPTION

In the following description, like numbers denote like elements. It should be appreciated that the illustrated drawings are not entirely in scale, and that the drawings mainly serve the purpose of illustrating embodiments of the invention.

Figure 1:
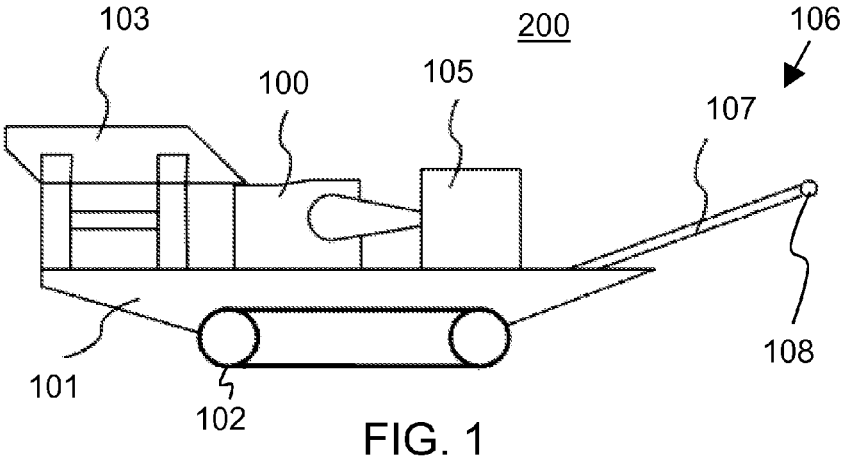
FIG. 1 shows a side view of a crushing plant which is suitable for crushing mineral material.

FIG. 1 shows a processing apparatus of mineral material, crushing plant 200 which comprises a jaw crusher 100. Crushing plant 200 has a feeder 103 for feeding material to the jaw crusher 100 and a belt conveyor 106 for conveying crushed product away off from the crushing plant.

The belt conveyor 106 presented in FIG. 1 comprises a belt 107 which is adapted to run at least around one drum 108. The crushing plant 200 also comprises a power source and a control center 105. The power source may be, for example, a diesel motor or an electric motor which offers energy for use of process units and hydraulic circuits.

The feeder 103, the crusher 100, power source 105 and conveyor 106 are attached to a frame 101 of the crushing plant which additionally comprises in this embodiment an track chassis 102 for moving the crushing plant 200. The crushing plant may also be completely or partially wheel based or movable on legs. Alternatively it may be movable/towable with the help of, for example, a truck or another external power source.

The mineral material may be, for example, mined stone or it may be demolition waste of a building such as concrete or bricks etc. In addition to the presented the crushing plant may also be a fixed crushing plant.

Figure 2:
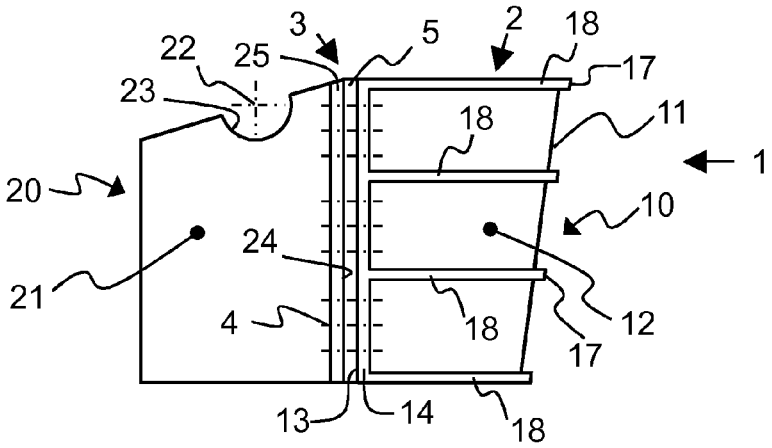
FIG. 2 shows a side view of a first frame of a jaw crusher which comprises two parts which are connected to each other with flange joints.
Figure 3:
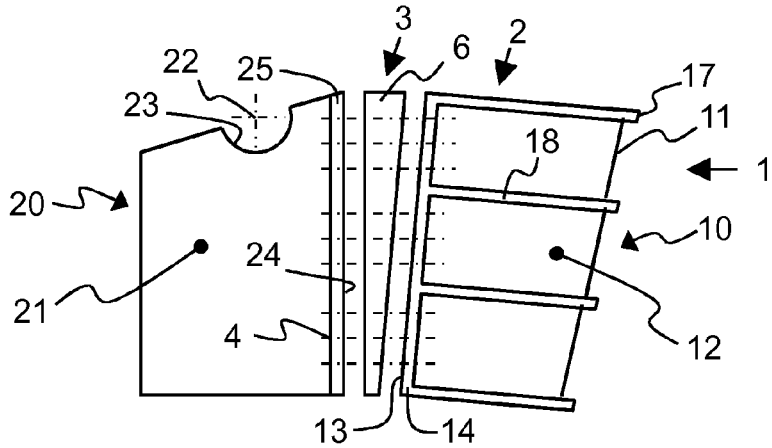
FIG. 3 shows the frame of FIG. 2 which may be equipped with adjusting wedges adaptable in connection with flange joints in order to adjust the feed opening and the jaw angle.
Figure 4:
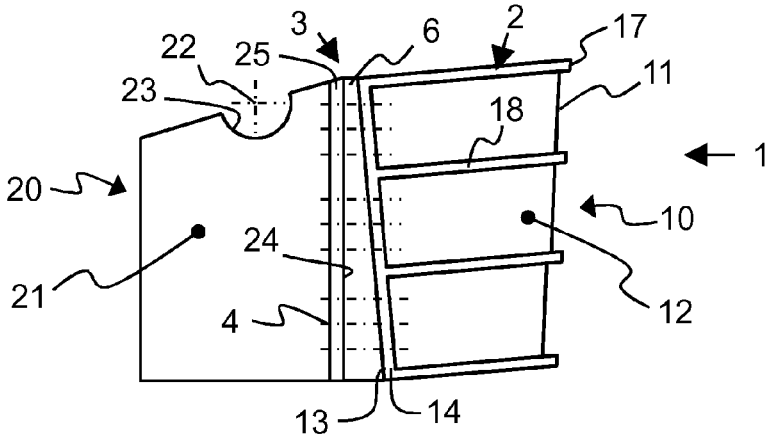
FIG. 4 shows the frame of FIG. 2 equipped with adjusting wedges which are mounted in an upside-down position compared to FIG. 3.

Embodiments of a frame 1 of the jaw crusher 100 presented with the help of FIGS. 2 to 4 may be used, for example, in the crushing plant 200 of FIG. 1. The frame 101 of the crushing plant may be configured to receive the mass of the frame 1 which may be even 20% lower than of known frames of crushers. Thus, the structure of the frame 101 of the crushing plant may be made lighter due to tolerance need of smaller load so that a cheaper structure of a crushing plant is achieved. The frame 1 comprises two parts, a front part 10 and a rear part 20. The front part 10 comprises a front wall 11 and sidewalls 12 attached to the front wall. The rear part 20 comprises rear side walls 21 and structure parts (not shown) attached to the rear side walls and holding rear side walls 21 attached to each other, which structure parts may be utilized, for example, for arranging support to a lower part of a moving jaw and, i.a., attaching a hydraulic cylinder. Because the structure parts holding the rear side walls 21 attached to each other may be casted to the side walls during the manufacturing there is no need for separate screw or nut attachment to the rear side walls 21 that decreases the amount of parts of a frame 3 and the amount of machined surface.

In the front part 10 in FIGS. 2 to 4 are presented ribs 18 in the longitudal direction of the frame 1, which ribs preferably are casted to the side walls 12, and ribs 17 in the transverse direction to the frame which preferably are casted to the front wall 11. Equally well, ribs in the longitudal and transverse direction may also be in applicable places of the rear part 20 where rigidity is required from the structure. Manufacturing the ribs by casting to the front and/or rear part in one and the same manufacturing phase is preferable when material may be placed to desired places of stress concentration. Especially, transversal ribs 17 manufactured to the front wall 11 of the front part 10 stiffen the structure of the front wall 11 for receiving crushing force directed outwards from the inside of the throat. The positioning of stiffening ribs presented in FIGS. 2 to 4 is one example for possible location and amount of stiffeners but the example shall not be understood as one limiting the invention. Locations and amounts of the ribs 17, 18 may be chosen in a way suitable for the crushing event.

A feed opening 2 in the frame 1 for mineral material and a throat under the feed opening 2 are mainly located in the area of the front part 10. The front part 10 forms at least the main part of the structure of the fixed jaw of the crusher 100 and a wear plate (not shown) mountable to the fixed jaw may be attached inside the front wall 11 of the front part 10. Preferably the rear part 20 receives an eccentric shaft (not shown) which forms a power transmission connection to the moving jaw of the crusher 100. A placing location of the eccentric shaft is denoted with 22. Bearings of the eccentric shaft may be attached to recesses 23 formed to the upper edges of the rear side walls 21.

The front part 10 and the rear part 20 are attached to each other with flange joints 3 which preferably are on sides of the frame 1. Flange joints may also be called flange-screw joints 3 in preferred embodiments in which the front part and the rear part are attached to each other by tightening screws 4 having influence on the flanges. In flange-screw joints 3 crushing force of the crusher is transmitted in the direction of the screws 4 so that crushing force is tension and not shear which occurs in commonly used frames of jaw crushers and is transmitted by pins.

Preferably at least the front part 10 or the rear part 20 are manufactured by casting to a single piece. More preferably both parts are made by casting.

In flange joints 3 flanges are formed to the front part 10 and rear part 20 of the frame 1 which flanges preferably are directed outside the frame 1 when viewed from the direction of the throat of the crusher. Preferably the flanges are perpendicular with respect to the side walls 12 and the rear side walls 21. The flanges may be unitary or consist of at least two flanges next to each other along the flange joint 3 on both sides of the frame 1. Flanges are presented as unitary in the embodiments of FIGS. 2 to 4. Flanges 14 of the front part 10 connect to rear parts of the longitudal ribs 18. The flanges comprise holes in which screws 4 may be mounted.

The front part 10 of the frame 1 comprises first flanges 14 in vertical rear edges 13 of the side walls 12 and the rear part 20 comprises second flanges 25 in vertical front edges 24 of the rear side walls 22. The first flanges 14 are directed preferably outwards from the vertical rear edges 13 of the side walls 12. The second flanges 25 are directed preferably outwards from the vertical front edges 24 of the rear side walls 21. Thus, the flange joints 3 are preferably arranged on the sides of the frame 1 and measures which take place for attachment and/or adjustment of the front and rear part such as mounting screws 4 through holes of the first flanges 14 and the second flanges 25, tightening of the screws 4 and optional adjusting of the feed opening 2 and/or the jaw angle to be explained later can be made from outside the frame 1. Preferably the upper edge of the front part 10 defines the major part of the outer edge of the feed opening 2.

Intermediate plates are attached in FIGS. 2 to 4 between the first flanges 14 and the second flanges 25 which flanges are located on both sides of the frame 1 of the crusher. Naturally, the frame 1 may also be assembled without said intermediate plates. Preferably the intermediate plates comprise one piece but they may also form of at least two successive pieces. Intermediate plates may also be attached more than one, one upon another, in the tightening direction of the screws 4 although, due to simplicity, only one intermediate plate is presented in the figures at the same time.

FIG. 2 presents an intermediate plate 5 with constant thickness and FIGS. 3 and 4 present a wedge-like intermediate plate or adjusting wedge 6 between parts of the frame 1. The intermediate plates 5; 6 are attached between the front part 10 and the rear part 20 so that the surfaces of the intermediate plates position themselves against a rear surface 13 of the front part 10 and a front surface 24 of the rear part 20. The thickness of the intermediate plate 5 presented in FIG. 2 may be changed, for example, to correspond concerning crushing conditions. With the help of an upwards expanding adjusting wedge 6 presented in FIG. 3 the jaw angle may, for example, be increased when compared to the case of FIG. 2. With the help of a downwards expanding adjusting wedge 6 presented in FIG. 4 the jaw angle may, for example, be increased when compared to cases of FIGS. 2 and 3. The adjusting wedge 6 may be turned to an upside-down position that has been illustrated with the help of FIGS. 3 and 4.

Intermediate plates 5 and 6 have holes and/or recesses for enabling passing through of screws 4 in places corresponding the locations of the screws 4 and the attaching flanges.

By mounting intermediate plates 5 with different thicknesses to the frame 1 the size of the feed opening and the size of the throat may be adjusted. With the help of the adjusting wedges 6 the size of the feed opening 2, the size of the throat and the jaw angle may be adjusted. Thus, with the same parts 10, 20 of the frame 1 throats of the crusher suitable for different crushing applications and crushing conditions may be created, for example, by changing different intermediate plates 5, 6 between the parts of the frame 1 or by turning the adjusting wedges 6 into a different position or by mounting several intermediate plates 5 and/or adjusting wedges 6 one upon another. The adjusting wedges 6 weigh less when compared to known adjustment plates of the jaw angle, and the manufacture of the adjusting wedges 6 is cheaper. Handling of the adjusting wedges 6 is easier than of known adjustment plates of the jaw angle due to their smaller weight. The size of the feed opening 2 of the frame 1 may be, if needed, increased or decreased according to applications and, additionally, the jaw angle may be increased or decreased. Thus, optimal crushing features may cost-effectively be created with one frame 1 and the crusher may be adjusted more powerful, if needed.

Preferably base plates (not shown in Figs.) are mounted under the nuts of the screws 4. The base plates may be individual for each screw 4. Preferably the base plates are equipped with at least two holes and/or recesses for several screws. Thus, i.a., eventual turning of the base plate in a wrong position, that is a disadvantage of single base plates, and distortion of the screw 4 or its remaining loosen when tightening may be avoided. With the distribution of screws in FIGS. 2 to 4 each base plate may comprise, for example, three holes. In cases of FIGS. 3 and 4 when the adjusting wedge 6 is used the base plate may also be by its form wedge-like in the counter direction of the wedge form of the adjusting wedge. With the wedge-like form of the base plate it can be assured that the lower surface of the nut touches evenly the surface of the base plate and the screw 4 does not deform when tightened. The base plate may comprise one surface seating against the nut or the base plate may be equipped with a step-like form comprising many surfaces directed against the nut.

The front part 10 may be attached, for example, to the frame 101 of the crushing plant with the help of supporting legs. Preferably wedge-like intermediate pieces are mounted between the front part 10 inclinable with the help of the adjusting wedge 6 and the supporting legs and wedge-like base plates in connection to attaching screws of the supporting legs, respectively. Preferably the form of these wedge-like intermediate pieces and base plates follow by their angle dimensioning the dimensioning of the adjusting wedges 6.

In embodiments according to FIGS. 2 to 4 the attachment of frame pieces 10, 20 to each other/their detachment from each other may be realized in addition to the traditional screw joint also by, for example, using one or several hydraulic actuators. The hydraulic actuator may comprise, for example, a hydraulic cylinder (not presented in the figures) which is attached to another frame piece 20 at a hole 4 and a piston arm may be fitted through the hole. A locking device such as a nut or a pin may be attached to the end of the piston arm. When pulling the piston to the side of the cylinder with the help of pressurization the frame pieces will attach to each other. Alternatively, for example, a traditional nut may be used to which other end a hydraulic nut such as Hydranut™ or other corresponding actuator is attached.

The attachment of the frame pieces to each other/their detachment from each other may be realized in a corresponding way as with a hydraulic actuator with other actuators such as an electric cylinder which may function with the help of an electric motor and a worm screw.

As an advantage of using actuators and actuator aided attaching means a smaller amount of manual work when attaching and detaching attaching instruments is reached. Additionally, work safety may be improved.

Embodiments of a frame 30 of the jaw crusher 100 presented with the help of FIGS. 5 to 8 may be used, for example, in the crushing plant 200 of FIG. 1. The frame 101 of the crushing plant may be configured to receive the mass of the frame 30 which may be even 20% lower than of known frames of crushers. Thus, the structure of the frame 101 of the crushing plant may be made lighter due to tolerance need of smaller load so that a cheaper structure of a crushing plant is achieved. The frame 30 comprises two parts, a front part 310 and a rear part 320. The front part 310 comprises a front wall 311 and sidewalls 312 attached to the front wall. The rear part 320 comprises rear side walls 321 and structure parts 322 attached to the rear side walls and holding rear side walls 321 attached to each other at a distance, which structure parts may be utilized, for example, for arranging support to the lower part of the moving jaw and, i.a., attaching a hydraulic cylinder. There may be several structure parts 322 one upon another in vertical direction of the rear part 320. The structure part 322 is a plate structure manufactured preferably by casting. In the area between the casted structure parts 322 there may be plate structures and/or rib structures manufactured by casting which connect the structure parts 322.

Because the structure parts 322 may be casted during manufacture from their ends to the rear side walls 321 there is no need for separate screw or nut attachment in the attachment of the structure parts 322 to the rear side walls 321 that decreases the amount of parts of the frame 30 and the amount of machined surface. Additionally, there is no need for after-tightening of nuts or bolts and the fretting fatigue is not a problem. The frame 30 may be manufactured lighter than known frames because the amount of joints connecting parts of the frame 30 is small. Due to the small amount of joints the amount of machined surface can be gotten low.

In the frame 30 the feed opening 2 for mineral material and the throat under the feed opening 2 are mainly located in the area of the front part 310. Movable crushing jaw (not shown), particularly mounting of the upper end of the crushing jaw and the eccentric shaft (not shown) are mainly located in the area of the rear part 320 according to some preferred embodiments. The front part 310 forms at least the main part of the structure of the fixed jaw of the crusher 100 and a wearing plate (not shown) mountable to the fixed jaw may be attached inside the front wall 311 of the front part 310. Preferably the rear part 320 receives the eccentric shaft (not shown) which forms a power transmission connection to the moving jaw of the crusher 100. A placing location of the eccentric shaft is denoted with 22. Bearings of the eccentric shaft may be attached to recesses 23 formed to the upper edges of the rear side walls 321.

In embodiments of FIGS. 5 to 8 the front part 310 and the rear part 320 are attached to each other with fork-pin joints 33 which are preferably on the sides of the frame 30. The front part 310 and/or the rear part 320 comprises in the side wall a fork-like joint part or fork 314; 324 (a fork eye) which comprises a pin hole 34 for a pin 35. The front part 310 and/or the rear part 320 comprises in its rear side wall a tongue 316; 326 (an eye) adaptable between the walls of the fork 324; 314. Each tongue 316; 326 comprises a pin hole 34 for a pin 35, correspondingly. For attaching the front part 310 to the rear part 320 pins 35 are mounted to the pin holes 34 after mounting tongues 316; 326 in between the forks 324; 314. Naturally, in between the walls of the fork located in one part of the frame 30 a fork structure can be arranged located in second part of the frame as a counter joint piece which may thus be an optional embodiment instead of the tongue.

Figure 8:
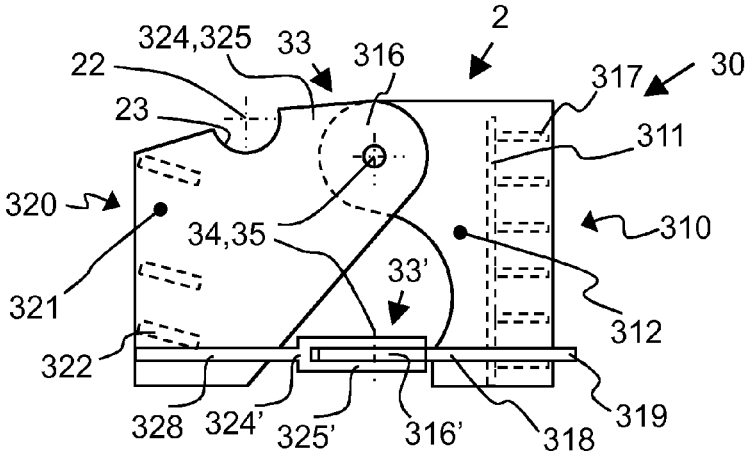
FIG. 8 shows a third frame of a jaw crusher of which front part and rear part are connected to each other with fork-pin joints.
Figure 5:
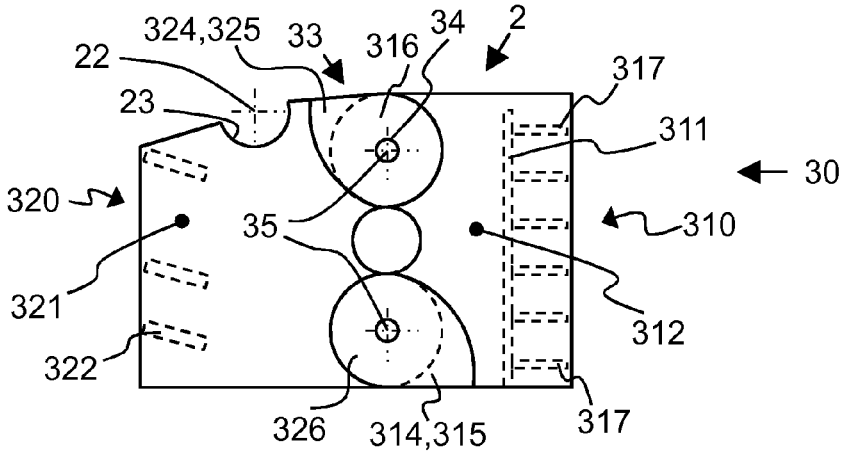
FIG. 5 shows a side view of a second embodiment of a frame of a jaw crusher which comprises a front part and a rear part which are connected to each other with fork-pin joints.
Figure 6:
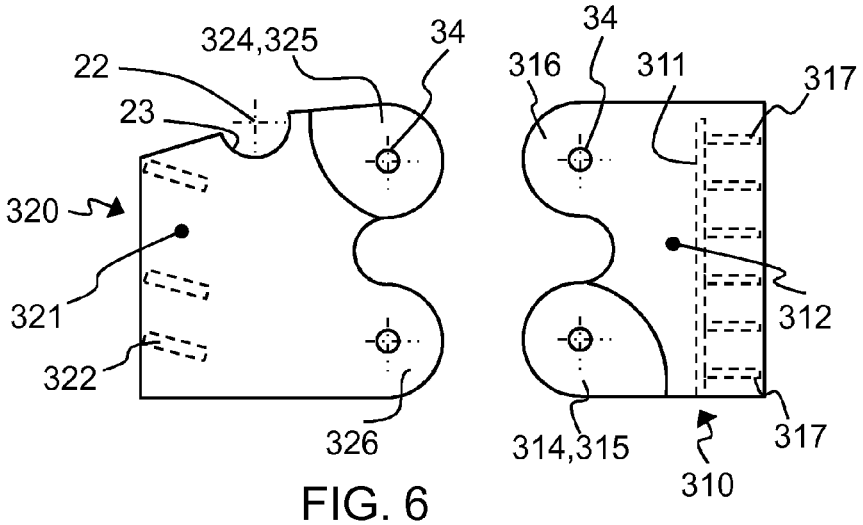
FIG. 6 shows a side view of frame parts of FIG. 5 apart from each other.
Figure 7:
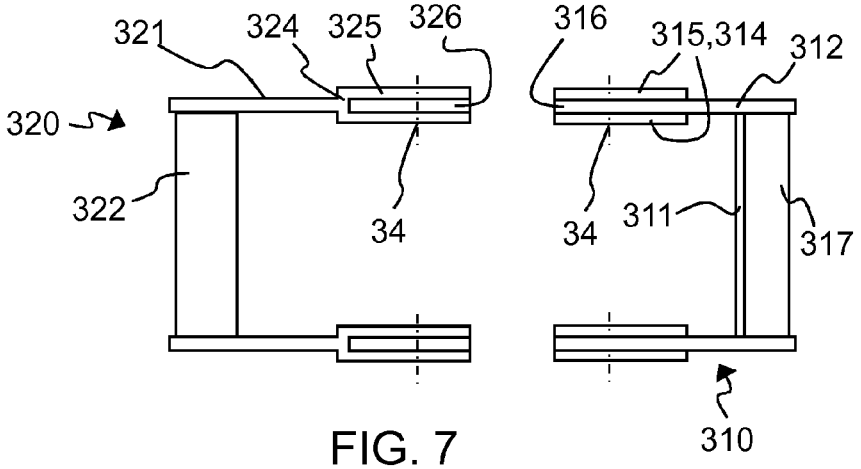
FIG. 7 shows a side view of parts of FIG. 6.

Location of the forks and the tongues of the fork-pin joints 33 in the front part 310 and the rear part 320 may be realized in many alternative ways. Preferably on both sides of the frame 30 there are two fork-pin joints 33. Preferably the fork-pin joints 33 are on the middle area of the side walls 312, 321. In some embodiments the forks and the tongues are plate structures directed along the walls 312; 321 of the front part 310 and the rear part 320 (FIGS. 5 to 7). In some embodiments the frame 30 comprises on its both sides an upper and a lower fork-pin joint 33. According to some embodiments the fork and the tongue of at least one fork-pin joint 33 in the frame 30 are arranged to plate structures which deviate from the direction of the walls 312; 321 of the front part 310 and rear part 320 (FIG. 8). In some embodiments the forks are in the front part and the tongues are in the rear part. In some embodiments the forks are in the rear part and the tongues are in the front part.

In the embodiments shown in FIGS. 5 to 8 the frame 30 comprises on its both sides an upper and a lower fork-pin joint 33. Preferably the forks and the tongues are casted as one unitary piece with the respective other structure of the front part and the rear part.

In the embodiments shown in FIGS. 5 to 8 forks 324 directed towards the front part 310 are formed in the upper portions of the rear side walls 321 of the rear part 320 which forks are formed of vertical walls 325 at a distance of another. The side wall 312 on both sides of the front part 310 is formed at its upper portion to be arranged in between the walls 325 of the forks 324 at both sides of the rear part 320.

The lower fork-pin joints 33 are located in an inverse direction with respect to the upper fork-pin joints 33 in FIGS. 5 to 7. Forks 314 directed towards the rear part 320 are formed in lower portions of the side walls 312 of the front part 310 which forks are formed of vertical walls 315 at a distance of another. The side wall 321 on both sides of the rear part 320 is formed at its lower portion to be arranged in between the walls 315 of the forks 314 at both sides of the front part 310.

The upper fork-pin joint 33 in FIG. 8 is shown as having respective features as the upper fork-pin joint 33 in FIGS. 5 to 7. In the lower fork-pin joints 33' the forks and the tongues are on same sides of the joint as in the upper fork-pin joints 33. In FIG. 8 a frame 30 is shown where the forks and the tongues of the lower fork-pin joint 33' are arranged as plate structures deviating from the direction of the walls 312; 321 of the front part 310 and the rear part 320.

The front part 310 comprises, in FIG. 8, a horizontal tongue 316' which is mounted in between the walls 325' of an also horizontal fork 324' located in the rear part 320. The tongue 316' is manufactured of a plate structure which preferably belongs to the casted piece of the front part. The tongue 316' is connected to the side wall 312 of the frame 30 preferably via a plate structured rib 318. The rib 318 is preferably directed along the length of the frame. The rib 318 located in the side wall preferably continues as a transverse directed rib 319 of the front part 310. The transverse rib 319 continues unitary to the side wall at the other side of the front part, respectively. Thus, a unitary rib structure 318-319-318 is formed in the front part 310 which connects the tongues 316' at both sides of the front part 310.

The rear part 320 comprises, in FIG. 8, a horizontal fork 324' which is manufactured of a plate structure which belongs preferably to the casted piece of the rear part 320. The fork 324' is connected to the rear side wall 321 of the frame 30 preferably via a plate structured rib 328. The rib 328 is preferably directed along the length of the frame. The rib 328 located in the rear side wall may continue in a way comparable with the front part passing by behind the rear part, for example, outside the rear part or join the plate part 322. The ribs 318, 319 and 328 form structures which stiffen the frame 30.

In the fork-pin joints 33 of FIGS. 5 to 8 crushing force is received as shear force which is directed to the pins. The fork-pin joint 33 may be gotten gapless, for example, by forming the fit between the pin 35 and the holes 34 as an interference fit. Because the joint is in the middle on the frame and not in the ends of the frame half of the amount of pins of some known solutions is needed. The upper and lower holes 34 may be arranged in such a place where a fatigue/stress concentration is created when the crusher is loaded in different locations. A probable location of the fatigue/stress concentration can be evaluated when the frame and forces affecting the frame are modelled in the design phase of the frame. In this way, the place in material of the side walls of the frame which is under the highest load can be replaced with the pin joint which has a suitable diameter, and the probability for creating a crack which leads to a damage may be decreased.

The pin 35 may be considered as a beam with two supports and not as a cantilever beam according to known steel cast pins wherein the pin 35 may be dimensioned by its diameter considerably smaller than known pins. In that case the hole 34 for fork-pin joint formed in the casting material of the frame 30 may be formed small so that the stress concentration is lower. In question is a situation defined to be dimensionally static wherein pins 35 and the fork eye 314, 324, 324' and the tongue 316, 316', 326 may be analytically dimensioned to correspond the load of the crushing event. There are rather fatigue critical places in the joints of the frame 30 and the influence of friction may be considered to be small. Fork-pin joints 33 are easy to mount. Pins 35 may be replaced easily. Heads of the pins 35 may, for example, be sunk in the material of the walls of the forks and attached with a nut.

Hydraulic actuators or other actuators, such as an electric cylinder which may function with the help of an electric motor and a worm screw, may be used in FIGS. 5 to 8 for the attachment of frame pieces to each other and their detachment from each other instead of the pin of the fork-pin joint.

The hydraulic actuator may comprise, for example, a hydraulic cylinder (not presented in the figures) which is attached to another frame piece at a hole of the fork and a piston arm may be pushed through the holes in the fork and the tongue. A locking device such as a nut or a pin may be attached to the end of the piston arm. When pulling the piston to the side of the cylinder with the help of pressurization the frame pieces will attach to each other. Alternatively, for example, a pin-like bolt may be used to which other end a hydraulic nut such as Hydranut™ or other corresponding actuator is attached.

As advantages of using actuators and actuator aided attaching means a smaller amount of manual work when attaching and detaching attaching instruments is reached. Additionally, work safety may be improved.

Preferably the side walls are connected at least to the front part 310 or the rear part 320 by casting to a single piece. More preferably the front part 310 and the rear part 320 are made by casting.

Figure 9:
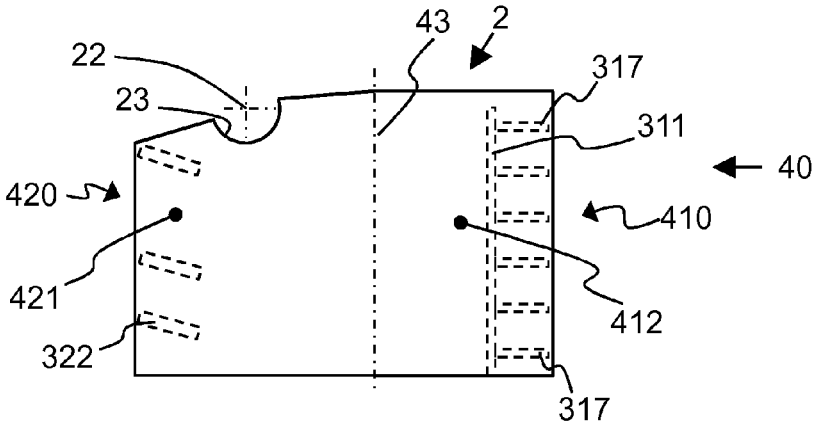
FIG. 9 shows a fourth frame of a jaw crusher the front part and rear part of which are connected to each other with welding joints on sides of the frame.

In FIG. 9, there is shown a frame 40 of a jaw crusher, a front part 410 and a rear part 420 of which frame are connected to each other with welding joints 43 which connect a side wall 412 and a rear side wall 421 on both sides of the frame 40. The welding joint 43 comprises preferably at least one welding seam with which the side wall 412 and the rear side wall 421 are connected to each other, for instance, end to end or lapped. The welding joint 43 may be located at the middle of the side wall area, for example, at an easy accessible location which is suitable for the manufacturing and preferred with regard the stresses. In other words, for instance, so that the eventually identified stress concentration is not located in the location of the welding joint 43.

The welding joint 43 located in the middle of the side wall area is in an easy place with respect to the quality assurance and finalizing of the welding. In this connection the method and apparatus forming the welding joint comprises all known welding methods in welding technology, for instance, such where the piece is joined to another piece using at least partial melting of material of the piece with or without additive material.

In the embodiments shown in FIGS. 5 to 9 the front wall 311 of the front part is preferably formed by casting to a unitary piece with the side walls, wherein the surface to be machined and attaching bolts may be decreased and the shear pins of the front and rear walls may be avoided.

Stiffeners 317 may be manufactured in connection with the front wall 311 in suitable locations which stiffeners receive with the front wall 311 forces of the crushing event. Stiffeners 317 are arranged preferably many upon another with suitable distances outside the front wall 311. The stiffeners 317 are preferably plate-like or rib-like.

The foregoing description provides non-limiting examples of some embodiments of the invention. It is clear to a person skilled in the art that the invention is not restricted to details presented, but that the invention can be implemented in other equivalent means.

Some of the features of the above-disclosed embodiments may be used to advantage without the use of other features. As such, the foregoing description shall be considered as merely illustrative of the principles of the invention, and not in limitation thereof. Hence, the scope of the invention is only restricted by the appended patent claims.

The invention claimed is:

1. A jaw crusher comprising:

a jaw;

an eccentric shaft configured to support the jaw;

a frame configured to receive the eccentric shaft and to support the eccentric shaft;

a power transmission configured to move the jaw with rotation of the eccentric shaft back and forth in a crushing direction and opposite to the crushing direction to create crushing forces with crushing movements in the crushing direction;

wherein the frame comprises:

a front part including a front wall and a pair of front side walls, wherein the front wall and the pair of front side walls are a unitary piece; and a rear part having an eccentric recess configured to receive the eccentric shaft, the rear part including a pair of rear side walls;

wherein the front and rear parts are attachable to each other and detachable from each other with flange-screw joints that connect the side walls of the front part with the side walls of the rear part on both sides of the frame and which joints bear tension forces corresponding to the crushing forces, wherein the eccentric recess is horizontally spaced from the joints.

2. The jaw crusher according to claim 1, wherein the rear part of the frame comprises a unitary piece that is formed of both of the rear side walls and at least one structure part connecting the rear side walls.

3. The jaw crusher according to claim 1, wherein at least one of the front part and the rear part is manufactured by casting.

4. The jaw crusher according to claim 1, wherein the flange-screw joint comprises in the side wall of the front part at least one first flange and in the rear side wall of the rear part at least one second flange, and first and second flanges are tightenable towards each other with attaching screws having influence on flanges.

5. The jaw crusher according to claim 1, wherein the flange-screw joint comprises an intermediate plate with a constant thickness mounted between the first and second flanges.

6. The jaw crusher according to claim 1, wherein the flange-screw joint comprises a wedge-shaped intermediate plate mounted peak pointed up or down between the first and second flanges.

7. The jaw crusher according to claim 1, wherein the frame comprises a welding joint on its both sides between the front side walls of the front part and the rear side walls of the rear part.

8. The jaw crusher according to claim 1, wherein the front part and the rear part of the frame are joinable to each other with a fork-pin joint.

9. The jaw crusher according to claim 8, wherein the fork-pin joint comprises a fork in the side walls of at least one of the front part and the rear part, and a tongue as a counter joining part, correspondingly, in the side walls of at least one of the rear part and the front part, which tongue is adaptable between the walls of the fork, and the fork and the tongue comprise holes for an attaching means.

10. The jaw crusher according to claim 8, wherein the frame comprises an upper and a lower fork-pin joint on both sides of the frame.

11. The jaw crusher according to claim 8, wherein the forks and the tongues are plate structures in the direction of the side walls of the front part and the rear part.

12. The jaw crusher according to claim 8, wherein at least one fork-pin joint comprises the fork and the tongue formed of plate structures deviating from the direction of the side walls of the front part and the rear part.

13. The jaw crusher according to claim 8, wherein the frame comprises as an attaching means for mounting the front part and the rear part to each other any of the following: screw, pin, hydraulic nut, hydraulic cylinder, electric cylinder.

14. A mobile crushing plant comprising:

a jaw crusher comprising:

a jaw;

an eccentric shaft configured to support the jaw;

a power transmission configured to move the jaw with rotation of the eccentric shaft back and forth in a crushing direction and opposite to the crushing direction to create crushing forces with crushing movements in the crushing direction;

a frame configured to receive the eccentric shaft and support the eccentric shaft, the frame having a front part including a front wall and a pair of side walls, wherein the front wall and the pair of side walls are formed as a unitary piece; and a rear part including an eccentric recess configured to receive an eccentric shaft, the rear part including a pair of side walls, wherein the front and rear parts are attachable to each other and detachable from each other with flange-screw joints that connect the side walls of the front part with the side walls of the rear part on both sides of the frame and which joints bear tension forces corresponding to the crushing forces, wherein the eccentric recess is horizontally spaced from the joints.

15. The crushing plant according to claim 14, wherein the crushing plant further comprises a crushing plant frame configured to receive the frame of the jaw crusher.

16. The jaw crusher according to claim 1, wherein the front part and the rear part of the frame are joinable to each other with screw joints including screws mounted such that the crushing forces are transmitted in the direction of the screws and the crushing forces cause tension rather than shear in the screws.

17. The crushing plant according to claim 14, wherein the front part and the rear part of the frame are joinable to each other with screw joints including screws mounted such that the crushing forces are transmitted in the direction of the screws and the crushing forces cause tension rather than shear in the screws.

* * * * *